US006443418B1

(12) United States Patent
Itamochi

(10) Patent No.: US 6,443,418 B1
(45) Date of Patent: Sep. 3, 2002

(54) ULTRA THIN-TYPE FORM PANEL, A FORM EMPLOYING THE SAME, AND A METHOD FOR CONSTRUCTING A FOUNDATION

(76) Inventor: Kozo Itamochi, 16-34, Kitawa Higashi 4-chome, Yodogawa-ku, Osaka (JP)

( * ) Notice: Subject to any disclaimer, the term of this patent is extended or adjusted under 35 U.S.C. 154(b) by 42 days.

(21) Appl. No.: 09/696,246

(22) Filed: Oct. 26, 2000

(51) Int. Cl.[7] ..... E04G 9/06; E04G 17/00

(52) U.S. Cl. ..... 249/34; 249/35; 249/40; 249/44; 249/47; 249/190; 249/192; 52/293.3; 52/294; 52/741.13; 52/742.14; 52/745.1

(58) Field of Search ..... 52/741.13, 742.14, 52/742.15, 745.1, 293.3, 294, 414, DIG. 15; 249/34, 35, 40, 44, 47, 189, 190, 192

(56) References Cited

U.S. PATENT DOCUMENTS

| | | | | | |
|---|---|---|---|---|---|
| 1,484,398 | A | * | 2/1924 | Kerber | 52/272 X |
| 3,458,168 | A | * | 7/1969 | White | 249/189 |
| 3,633,327 | A | * | 1/1972 | Klingensmith et al. | 52/293.3 X |
| 4,695,033 | A | * | 9/1987 | Imaeda et al. | 249/189 |
| 5,165,213 | A | * | 11/1992 | Finch et al. | 52/588.1 |
| 6,076,320 | A | * | 6/2000 | Butler | 52/293.3 X |
| 6,205,725 | B1 | * | 3/2001 | Butler | 52/293.3 X |

FOREIGN PATENT DOCUMENTS

| | | | | |
|---|---|---|---|---|
| DE | 673445 | * | 3/1939 | 249/40 |
| JP | 5-133028 A | | 5/1993 | |
| JP | 5-255988 A | | 10/1993 | |
| JP | 6-288085 | * | 10/1994 | 249/189 |

* cited by examiner

*Primary Examiner*—Laura A. Callo
(74) *Attorney, Agent, or Firm*—Griffin & Szipl, P.C.

(57) ABSTRACT

To provide an ultra thin-type metallic form panel, a form employing the same, and a method for constructing a foundation with which labor in performing operations for constructing a concrete building may be remarkably saved. Form panels 2 are used as a form 1 for constructing a foundation, each panel including a plurality reinforcing projecting lines 5 obtained by bending a metallic plate to extend in longitudinal directions and formed in an aligned manner with intervals being formed in lateral directions, wherein guiding portions for bending 20 are formed at intermediate portions in the longitudinal directions by cutting at least top surfaces and both lateral sides of the respective reinforcing projecting lines 5 in lateral directions and the remaining portions are remained as coupling portions 21.

17 Claims, 11 Drawing Sheets

52
52
51
50
4
2
20
30
3
G

ULTRA THIN-TYPE FORM PANEL, A FORM EMPLOYING THE SAME, AND A METHOD FOR CONSTRUCTING A FOUNDATION

BACKGROUND OF THE INVENTION

The present invention relates to an ultra thin-type metallic form panel suitable for constructing a foundation of a building, a form employing the same, and a method for constructing a foundation.

DESCRIPTION OF THE PRIOR ART

Forms employing metallic panels that underwent rust preventing treatments, such as galvanizing, are recently being used as forms in constructing concrete buildings. Such a method for constructing concrete buildings is advantageous in that labor for constructing forms can be saved by omitting poles, or the like, for supporting back surfaces of forms by fixing the forms to positions for constructing the concrete building by using nails or the like. Thus, labor for decommissioning forms can be saved by embedding the forms into the concrete, and the strength of the concrete building may be improved.

An example of such a form is suggested, for instance, in Japanese Patent Unexamined Publication No. HEI5-133028 (1993), wherein the form is comprised of a metallic form panel formed with a plurality of reinforcing ribs extending in an identical in-plane direction and obtained by bending a metallic plate. Outlet holes allowing seepage of concrete are formed between the reinforcing ribs of the metallic form panel. By using such forms, a part of the installed concrete is seeped through the outlet holes and is hardened. Because the hardened concrete binds the form panels to the installed concrete, no clearance will be formed between the concrete building and the form panels even though the installed concrete shrinks upon curing and hardening. On the other hand, the following subjects still remain in constructing a concrete building by using such forms.

(1) In constructing a foundation, the forms will be exposed above the ground surface so that finishing mortar needs to be constructed to the exposed portions for preventing degradations in external appearance of the building. Such operations are troublesome.

(2) In constructing a foundation with a footing portion, the forms need to be constructed and the concrete installed by performing at least two steps, for the footing portion and a footing beam portion, so that labor for performing these construction operations could not be saved using present methods.

(3) Since adjoining forms are combined by using screws or the like, such combining operations are troublesome.

(4) One would cut his or her fingers with lateral edges of the forms when constructing the forms so that safety considerations were insufficient.

SUMMARY OF THE INVENTION

It is an object of the present invention to provide an ultra thin-type metallic form panel, a form employing the same, and a method for constructing a foundation with which labor for performing construction of a concrete building can be remarkably saved.

The ultra thin-type form panel according to a first preferred embodiment in accordance with the present invention is arranged in that a plurality of reinforcing projecting lines extending in longitudinal directions obtained by bending a metallic plate are formed in an aligned manner with intervals being formed in lateral directions, wherein guiding portions for bending are formed at intermediate portions in the longitudinal directions by cutting at least top surfaces and both lateral sides of the respective reinforcing projecting lines in lateral directions and the remaining portions are remained as coupling portions.

Since these form panels may be bent along the guiding portions for bending, the form panels may be bent to assume shapes that correspond to shapes of outer surfaces of a concrete building including portions which thicknesses differ from each other such that a possible scope of constructing the concrete building that may be built in a single step by installing concrete to thereby decrease the number of constructing forms. For instance, in case of constructing a foundation including a footing portion, it was necessary to construct the forms by performing two steps as described above in a conventional method for construction. However, since the form can be constructed by bending the form panel to fit along the footing portion and the footing beam portion so that the foundation may be built in a single step for constructing the form.

When constructing the foundation as a concrete building, portions of the form panels that are exposed above the ground surface may be folded in a downward manner along the guiding portions for bending to thereby embed the entire form panels into the ground. In other words, since it is possible to perform construction such that no form panels are exposed to the exterior upon completion of back filling of the foundation, operations for forming finishing mortar to the form panels may be omitted.

The ultra thin-type form panel according to a second preferred embodiment of the present invention is arranged in that a plurality reinforcing projecting lines extending in longitudinal directions obtained by bending a metallic plate are formed in an aligned manner with intervals being formed in lateral directions, wherein at least a part of top surfaces of respective reinforcing projecting lines remain as coupling portions at intermediate portions in longitudinal directions while the remaining portions are cut in lateral directions to form guiding portions for bending.

Similar to the first preferred embodiment, by bending the form panels along the guiding portions for bending, a possible scope of constructing the concrete building that may be built in a single step is achieved by installing concrete to thereby decrease the number of constructing forms. Further, since the form panels may be prevented from being exposed to the exterior upon performing back filling of the foundation, operations for forming finishing mortar to the form panels may be omitted.

The ultra thin-type form panel of a third preferred embodiment of the present invention is arranged in that the guiding portions for bending are formed to correspond to corner portions of lateral surfaces of a foundation of a building to be constructed. With this arrangement, by bending the panels along the guiding portions for bending, such that the form panels fit along the shapes of the lateral sides of the foundation, it is possible to construct the foundation in a single step even though the foundation may include a footing portion and a footing beam portion.

The ultra thin-type form panel of a fourth preferred embodiment of the present invention is arranged in that the guiding portions for bending are formed to be disposed downward of a ground surface when constructing a foundation for a building. With this arrangement, by bending portions of the form panels that are exposed to above the ground surface in a downward manner along the guiding portions for bending upon completion of the foundation, an advantage occurs in that no finishing mortar needs to be constructed to a portion of the form panel that is exposed to above the ground surface. Thus, foundation construction operations are remarkably saved.

The ultra thin-type form panel of a fifth preferred embodiment of the present invention is arranged in that clinch portions are formed to be successive in longitudinal directions to both lateral edges of the metallic plate in lateral directions. With this arrangement, it is possible to prevent lateral edges of form panels from becoming sharp thereby preventing inconveniences in which one may cut one's fingers at the time of construction so that safety of handling form panels may be improved.

The ultra thin-type form panel of a sixth preferred embodiment of the present invention is arranged so that engaging holes are formed on one side portion of the form panel in the lateral direction while engaging projecting portions are formed on the other side portion in the lateral direction for engaging the engaging projecting portions to the engaging holes such that adjoining form panels are made to be connectable. With this arrangement, adjoining form panels may be sequentially combined by fitting the fitting projecting portions to the engaging holes so that operations for constructing the forms may be effectively performed.

The ultra thin-type form panel of a seventh preferred embodiment of the present invention is arranged in that outlet holes with aperture widths allowing seepage of concrete are formed on the form panel between adjoining reinforcing projecting lines. With this arrangement, concrete installed between forms will seep through the outlet holes and cure. Owing to the concrete that has seeped through the outlet holes and cured, the form panels and the installed concrete will be firmly combined so that clearances are prevented from being formed between the concrete and the form panels upon shrinkage of the installed concreted through curing. Thus, the strength of the outer surface of the concrete building may be improved.

The form in accordance with an eighth preferred embodiment of the present invention comprises the ultra thin-type form panel in accordance with any one or the first seven preferred embodiment, and modified to include a first and second reinforcing rail outwardly fitted and fixed to both lateral edges of the form panel in longitudinal directions along the lateral direction of the form panel for retaining the form panel in a plate-like shape.

According to this form, the form is retained in a planar shape through the reinforcing projecting lines formed on the form panels and the first and second reinforcing rails outwardly fitted to both lateral edges of the form panels in longitudinal directions to thereby improve the strength of the form and to effectively prevent deformation of the form panels upon receiving pressure of the installed concrete.

Similar to the first and second preferred embodiments of the present invention, by bending the form panels along the guiding portion for bending, a possible scope of constructing the concrete building that may be built in a single step is achieved by installing concrete to thereby decrease the number of constructing forms and to further omit performing back filling of the form panels when constructing the foundation.

The form in accordance with a ninth preferred embodiment of the present invention is arranged so that at least the first reinforcing rail is formed to assume a substantially U-shaped section, and wherein notched portions for inserting tip end portions of a nailing machine therein are formed at specified intervals on either one of opposing lateral walls of the reinforcing rail. With this arrangement, the tip end portions of the nailing machine may be inserted even though the space between the lateral walls of the reinforcing rail is small so that the reinforcing rail may be easily fixed to the concrete sub-slab or the like.

The form in accordance with a tenth preferred embodiment of the present invention is arranged so that the reinforcing rails are formed to assume a substantially U-shaped section, wherein cutting portions extending in lateral directions are formed on one end portion of an intermediate wall that is formed in a successive manner to both lateral walls of the reinforcing rails, and wherein spaces between opposing lateral walls of the reinforcing rails are adjusted via the cutting portions so that adjoining reinforcing rails may be fitted together. Such an arrangement is preferable since it is possible to employ a member having a substantially U-shaped section, which is advantageously strong for use as a reinforcing rail, and because adjoining reinforcing rails may be easily combined.

The form in accordance with an eleventh preferred embodiment of the present invention is arranged so that both reinforcing rails are arranged to be of identical shapes. With this arrangement, it is possible to reduce costs for manufacturing the reinforcing rails and to reliably prevent assembling errors of the first reinforcing rails and the second reinforcing rails.

The form in accordance with a twelfth preferred embodiment of the present invention is arranged so that reinforcing members for reinforcing the form panels are fixed to inner sides of the reinforcing projecting lines or between adjoining reinforcing projecting lines. By the provision of such reinforcing members, it is possible to improve the strength of the forms and to prevent deformation of the form panels upon receiving pressure of installed concrete in an even more effective manner.

The method for constructing a foundation in accordance with a thirteenth preferred embodiment of the present invention is a method for constructing a foundation employing the form having the features of any one of the eighth to the twelfth preferred embodiments, wherein the method comprises the steps of fixing a pair of first reinforcing rails to be spaced apart from each other in a substantially parallel manner on specified positions of a concrete sub-slab laid on a construction site and fitting and fixing form panels to both first reinforcing rails, and constructing a pair of forms by respectively fitting and fixing second reinforcing rails on upper end portions of the form panels, and installing concrete to between both forms upon assembling a separator to bridge over both forms for setting a space between these.

Since the above-described form panels are employed in this method for construction, by bending the form panels along the guiding portions for bending, a possible scope of constructing the concrete building that may be built in a single step by installing concrete is achieved to thereby decrease the number of constructing forms. Further, since the form panels may be prevented from being exposed to the exterior when constructing the foundation, operations for forming finishing mortar to the form panels may be omitted.

The method for constructing a foundation in accordance with a fourteenth preferred embodiment of the present invention is arranged so that the form panels are bent at guiding portions for bending such that the form panels fit along lateral surfaces of the foundation at the time of constructing the forms. With this arrangement, it is possible to build the foundation by installing concrete in a single step by bending the form panels to correspond to the shapes of the outer surfaces of the foundation even though the foundation may include a footing portion and a footing beam portion.

The method for constructing a foundation in accordance with a fifteenth preferred embodiment of the present invention is arranged so that back filling of the foundation is performed upon installing concrete to between both forms for curing and hardening, and after bending the forms that are exposed above the ground surface in a downward manner along the guiding portions for bending. With this arrangement, it is possible to prevent the form panel from being exposed above the ground surface and to omit operations for constructing finishing mortar to the form panel.

The method for constructing a foundation in accordance with a sixteenth preferred embodiment of the present invention is arranged so that the form is constructed by adjusting a position for fixing the form panel to the first reinforcing rail and a position for fixing the second reinforcing rail to the form panel such that a height of the second reinforcing rail becomes a set value. The concrete sub-slab is generally constructed in a relatively rough manner with variations in heights in upper surfaces ranging from 30 to 50 mm while variations in heights of upper ends of the forms needs to be set at high accuracy of approximately±5 mm. By adjusting the position for fixing the form panel to the first reinforcing rail and the position for fixing the second reinforcing rail to the form panel in a height direction, the height of the second reinforcing rail may be accurately adjusted to meet the set value.

DESCRIPTION OF THE PREFERRED EMBODIMENTS

Embodiments of the present invention will now be explained with reference to the drawings.

Figure 1:
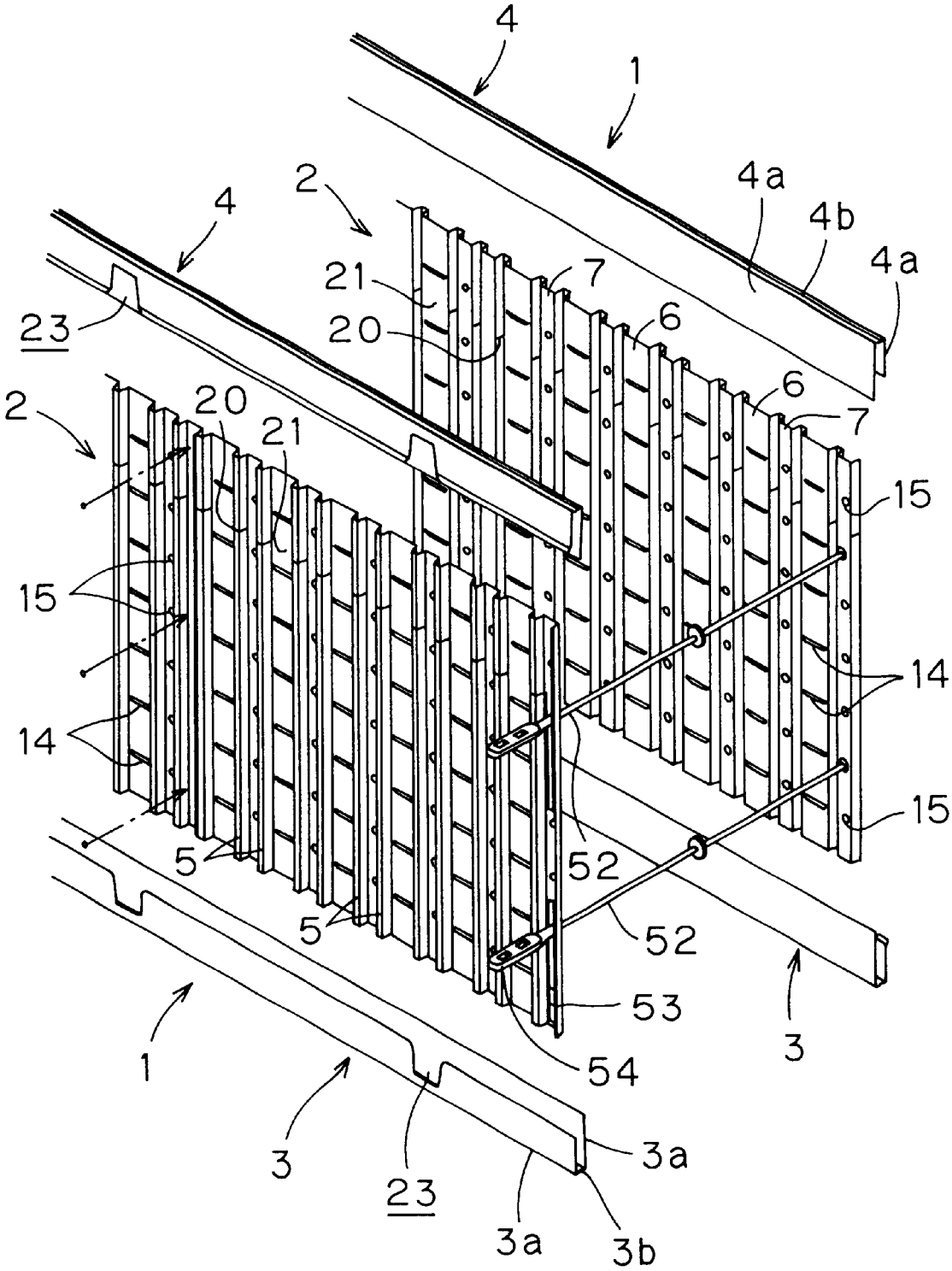
FIG. 1 is an exploded perspective view of forms at the time of constructing a foundation.

As illustrated in FIG. 1, a form 1 is comprised of an ultra thin-type metallic form panel (hereinafter simply referred to as "form panel") 2, a lower reinforcing rail (first reinforcing rail) 3 that is outwardly fitted and fixed to a lower edge of the form panel 2 and an upper reinforcing rail (second reinforcing rail) 4 that is outwardly fitted and fixed to an upper edge of the form panel 2.

The form panel 2 will first be explained.

The form panel 2 is formed by press forming a metallic plate, which is a steel plate that underwent galvanizing as rust preventing treatment. It is alternatively possible to perform methods such as metal plating other than galvanizing or applying a rust preventing coating as the rust preventing treatment. While a thickness of the steel plate may be suitably set in accordance with sizes of the concrete building or the like, one having a thickness of, for instance, 0.2 to 2.0 mm may be suitably used.

Figure 2:
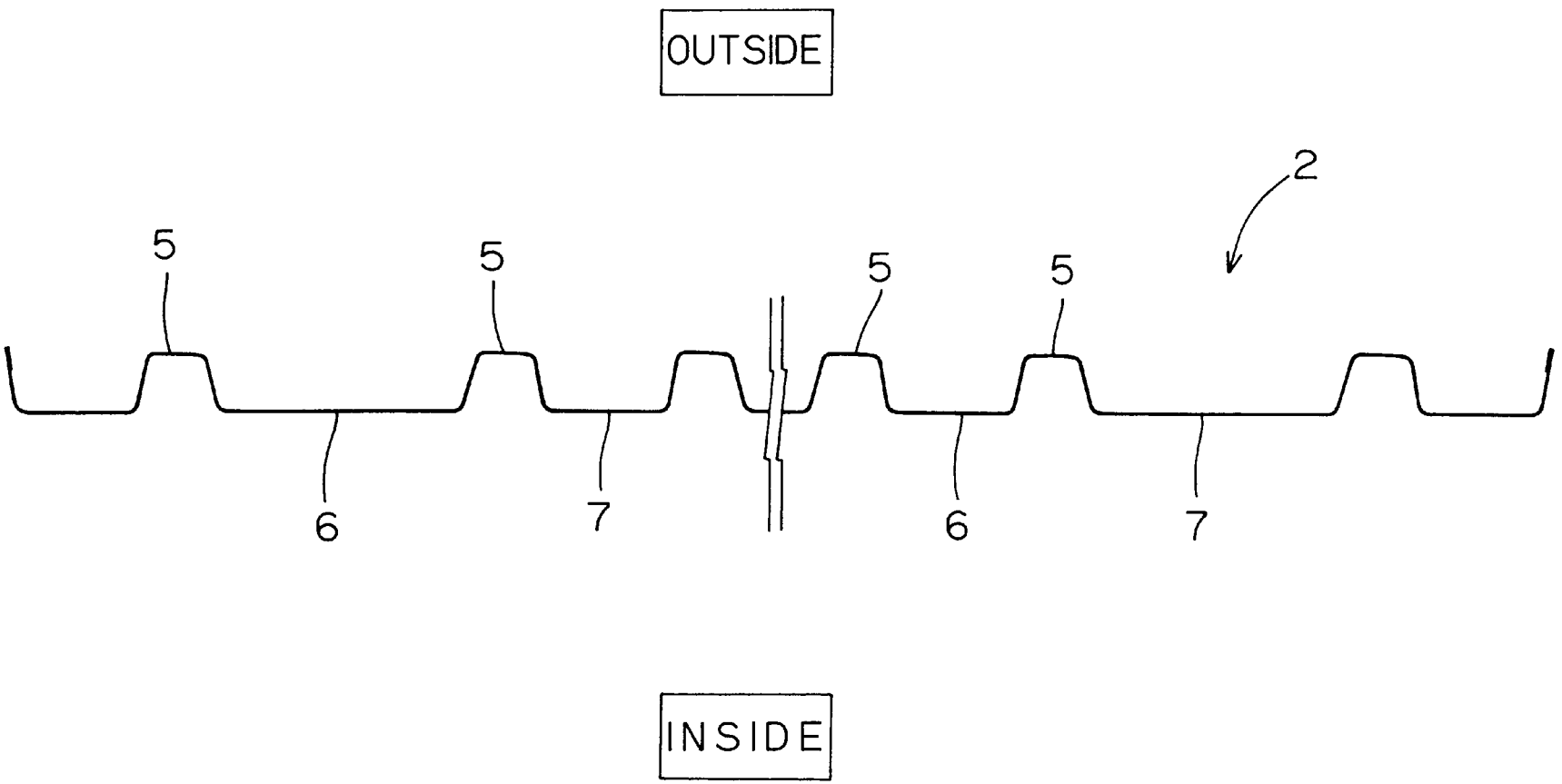
FIG. 2 is a plan view of a form panel.
Figure 3A:
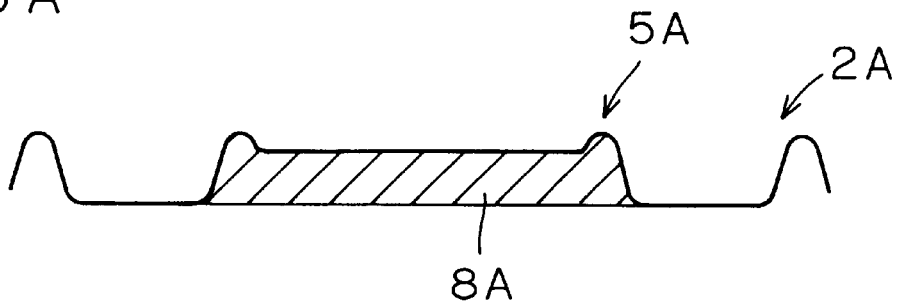
FIG. 3 is a partial plan view of form panels of different arrangements.
Figure 3B:
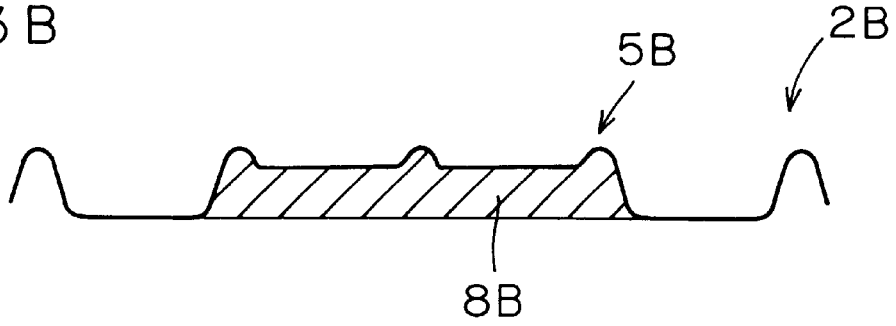
Figure 3C:
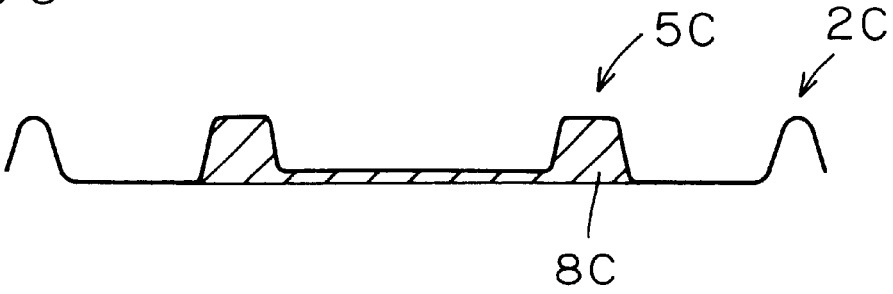
Figure 3D:
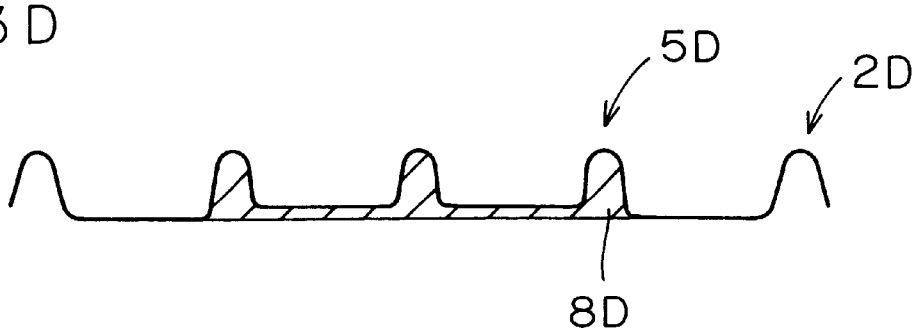

As illustrated in FIGS. 1 and 2, the form panel 2 is formed with a plurality of reinforcing projecting lines 5 extending in vertical directions (longitudinal directions) that are aligned in right and left directions (lateral directions) at certain intervals, wherein flat portions 6 of broad width and flat portions 7 of narrow width are alternately formed between adjoining reinforcing projecting lines 5. Sectional shapes or sizes of the reinforcing projecting lines 5 or intervals between adjoining reinforcing projecting lines 5 may be arbitrarily set. It is, for instance, possible to employ reinforcing projecting lines 5A to 5D having sectional shapes as illustrated in FIGS. 3(*a*) to 3(*d*) as the reinforcing projecting lines 5. However, in case capacities of spaces 8A to 8D inward of the reinforcing projecting lines 5A to 5D (portions indicated by the hatchings) become too large, the amount of concrete to be installed will be increased accordingly so that it is preferable to set these such that these spaces 8A to 8D inward of the reinforcing projecting lines 5A to 5D become as small as possible while securing sufficient strength.

Figure 4A:
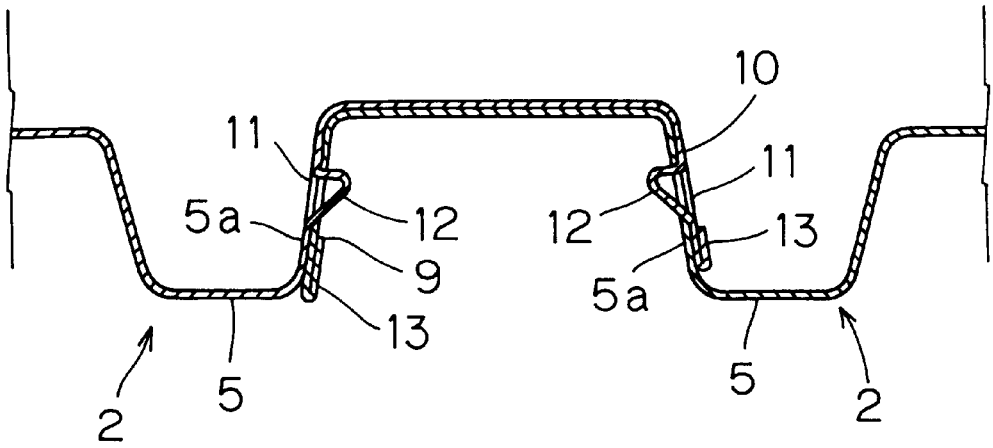
FIG. 4 is an explanatory view of a structure for combining adjoining form panels.
Figure 4B:
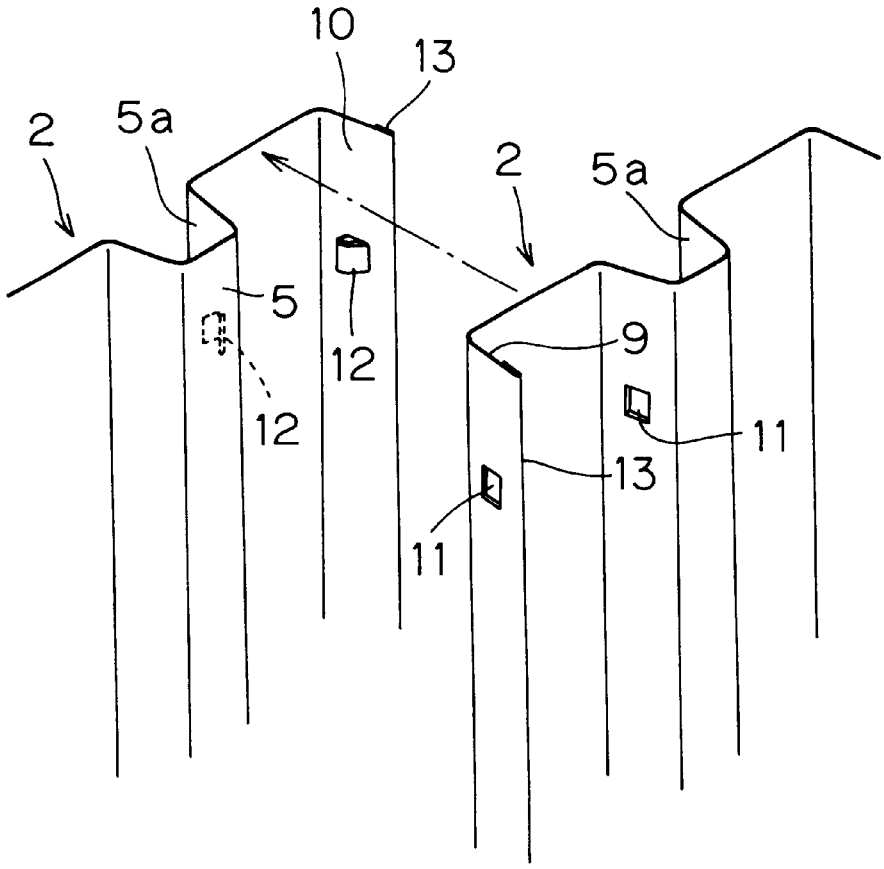

For combining form panels 2 which are disposed in an adjoining manner, both lateral portions of the form panels 2 are provided with combining structures achieved, for instance, through convex and concave fitting capable of providing combination through one-touch operation. The arrangement may be as follows: as illustrated in FIG. 4, fitting edge portions 9, 10 are formed on both lateral portions of the form panel 2 extending to a same side as the reinforcing projecting lines 5, engaging holes 11 are formed on the first fitting edge portion 9 and at the lateral wall 5*a* of the reinforcing projecting line 5 opposing thereto at specified intervals in vertical directions, and engaging projecting portions 12 fitting to the engaging holes 11 are formed on the second fitting edge portion 10 and at the lateral wall 5*a* of the reinforcing projecting line 5 opposing thereto at specified intervals in vertical directions; and as illustrated in FIG. 4(*a*), the second fitting edge portion 10 and the lateral wall 5*a* of the reinforcing projecting line 5 opposing thereto are fit to between the first engaging edge portion 9 and the reinforcing projecting line 5 adjoining thereto such that the engaging projecting portions 12 are fitted to the engaging holes 11 for combining adjoining form panels 3. It is, however, possible to employ a combining structure other than the above explained one or to simply screw two adjoining form panels 2 by overlapping their lateral edges. It is further possible to combine adjoining form panels 2 by employing both of the above-described combining structure and screwing.

As illustrated in FIG. 4, clinch portions 13 are formed over entire lengths in vertical directions of right and left lateral edges of the form panel 2, these being arranged to prevent an operator from cutting his or her fingers or hands at the time of transport or construction of the form panels 2. It should be noted that it is preferable that the clinch portions 13 are formed also at upper edges and lower edges of the form panels 2. It is alternatively possible to round corner portions of the form panels 2 such that they are not sharply pointing.

Figure 5:
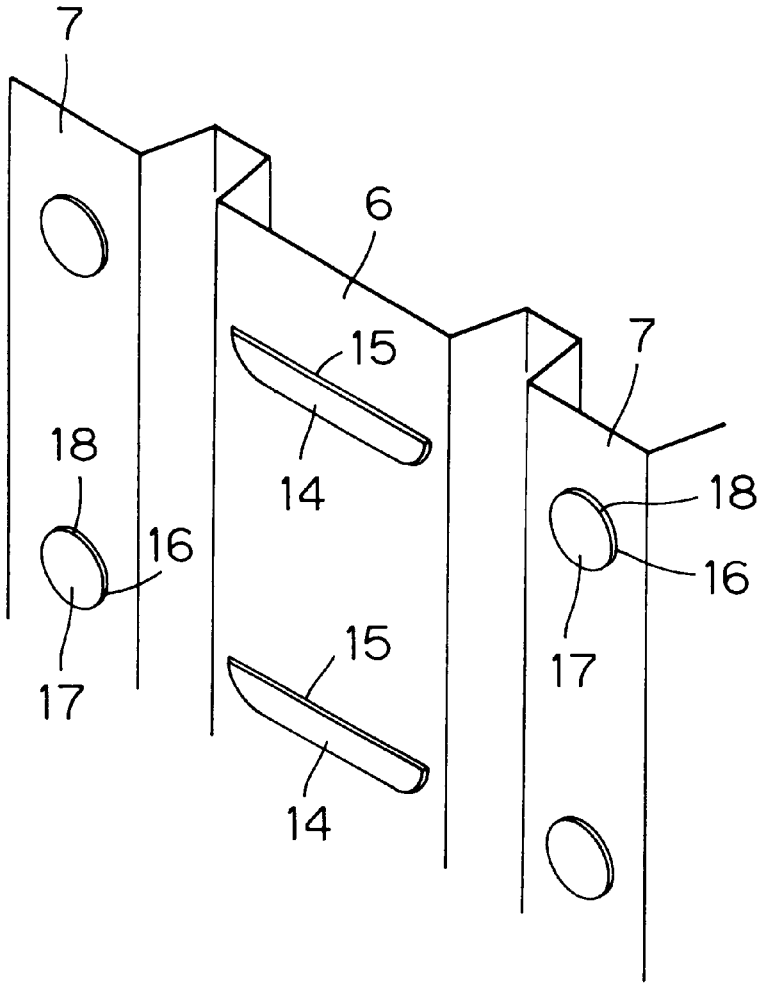
FIG. 5 is an explanatory view of portions for forming outlet holes and slits.

As illustrated in FIGS. 1 and 5. projecting portions 14 that are elongated in lateral directions are formed at specified intervals in vertical directions of the flat portions 6 of broad width formed between the reinforcing projecting lines 5, wherein outlet holes 15 of an aperture width with which concrete will seep are formed on upper edges of the projecting portions 14. Note that the outlet holes 15 may also formed on lower edges of the projecting portions 14.

Cutoff pieces 17 that are cut in a round manner while leaving a part thereof as connecting portions 16 are provided at specified intervals on the flat portions 7 of narrow width formed between the reinforcing projecting lines 5, wherein piercing holes are formed by eliminating cutoff pieces 17 that are formed at positions to which separators 52 are to be fixed at the time of constructing the forms such that end portions of the separators 52 are pierced through these piercing holes to fix the separators 52 thereat. It should be noted that slits 18 formed at outer peripheral portions of the cutoff pieces 17 are formed, similarly to the outlet holes 15, to assume an aperture width with which concrete is allowed to seep.

Through the provision of the outlet holes 15 and the slits 18 in the form panels 2, apart of concrete will seep to the exterior and cure when concrete is installed to between forms 1 that are disposed in parallel to each other in a manner as it will be described later, and the form panels 2 will be combined to the installed concrete through the cured concrete so that clearances are prevented from being formed between the concrete building and the form panels 2 upon shrinkage of the concrete through curing and hardening. However, in case the form panels 2 are bent downward upon completion of the foundation in a manner as it will be described later, it is preferable that no outlet holes 15 are formed at portions of the form panels 2 that are to be bent downward so that the form panels 2 may be easily detached from the foundation.

Figure 6:
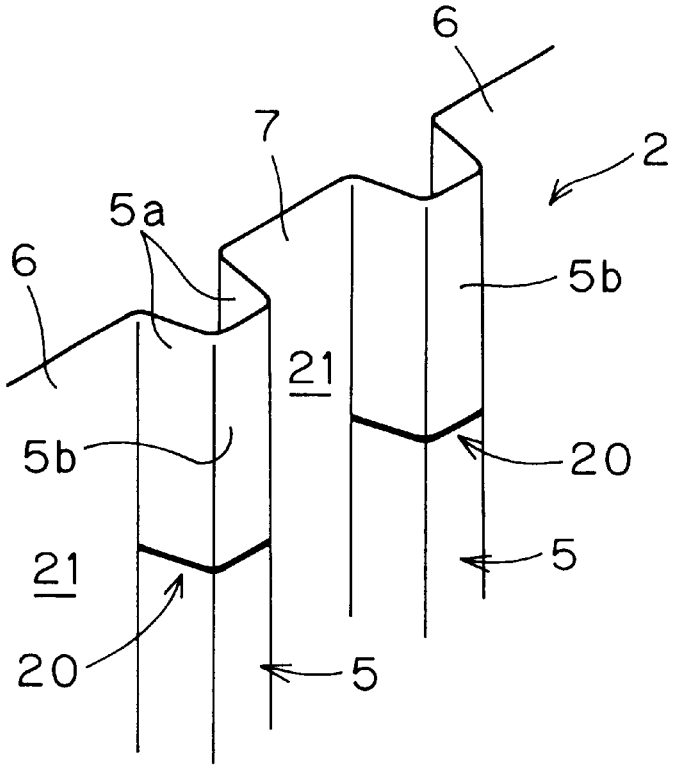
FIG. 6 is an explanatory view of portions for forming guiding portions for bending.
Figure 7:
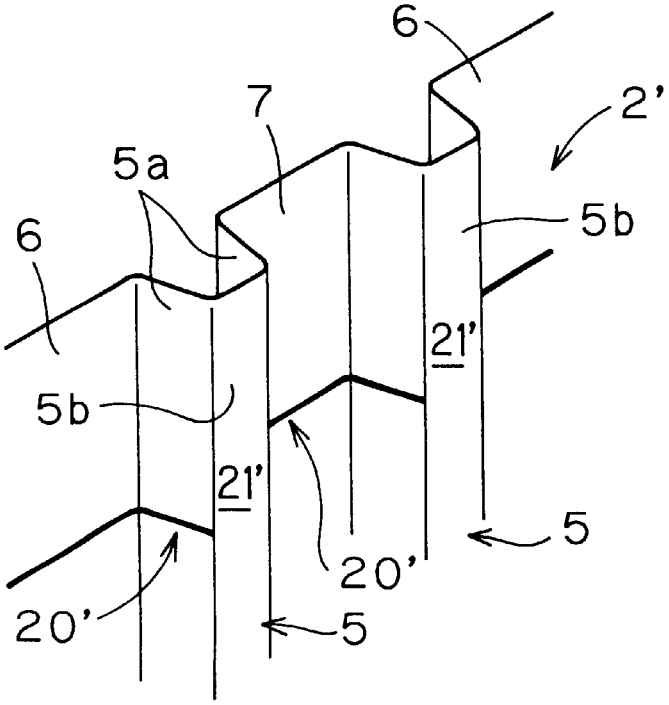
FIG. 7 is an explanatory view of portions for forming guiding portions for bending of another arrangement.

As illustrated in FIGS. 1 and 6, guiding portions for bending 20 obtained by cutting at least both lateral surfaces 5*a* and the top surface 5*b* of each reinforcing projecting line 5 in lateral directions are formed at an intermediate portion of the form panel 2 in vertical direction with the remaining portions forming the coupling portions 21. It is alternatively possible to form guiding portions for bending 20' as in the form panel 2' as illustrated in FIG. 7, in which at least a part of the top surface 5*b* of each reinforcing projecting line 5 is remained as the coupling portions 21 while the remaining portions are cut in lateral directions.

Figures 11A, 11B, 11C:
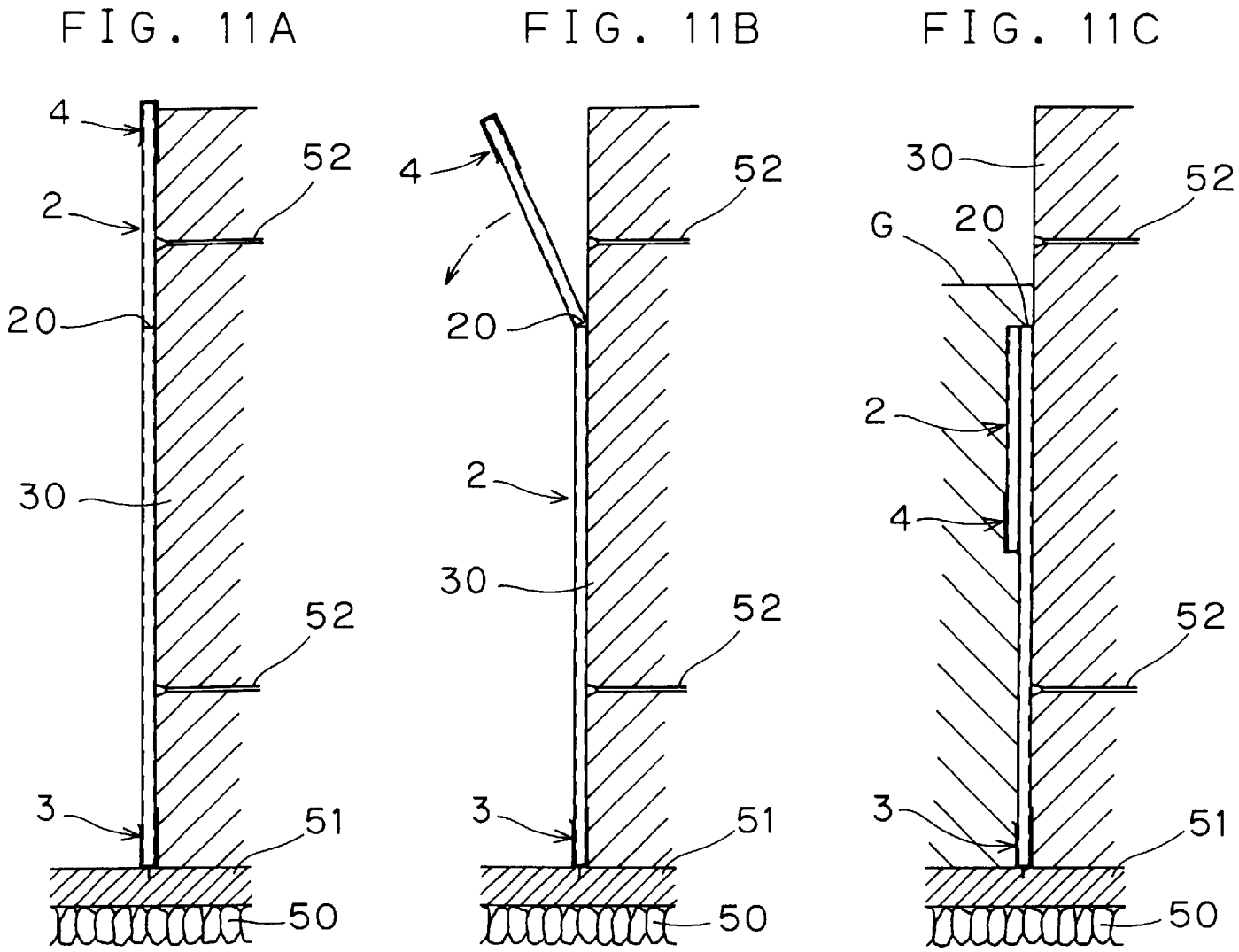
FIG. 11 is an explanatory view of the method for constructing the foundation.
Figure 12B:
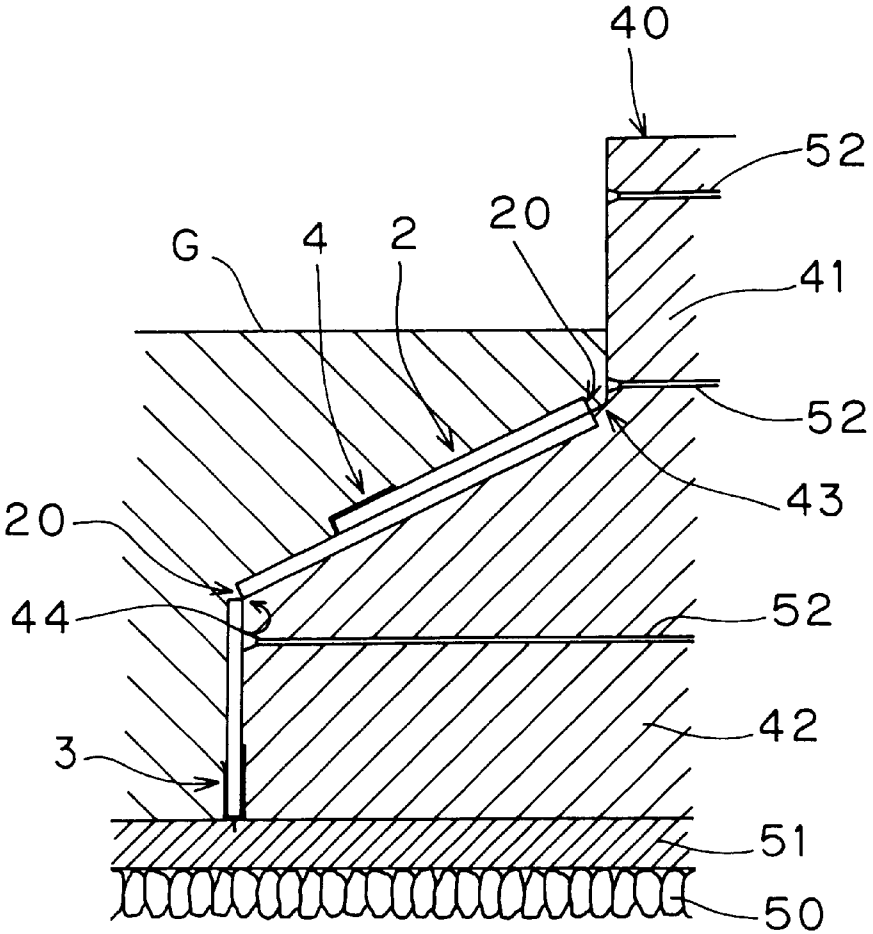
FIG. 12 is an explanatory view of a method for constructing a foundation of another arrangement.
Figure 12A:
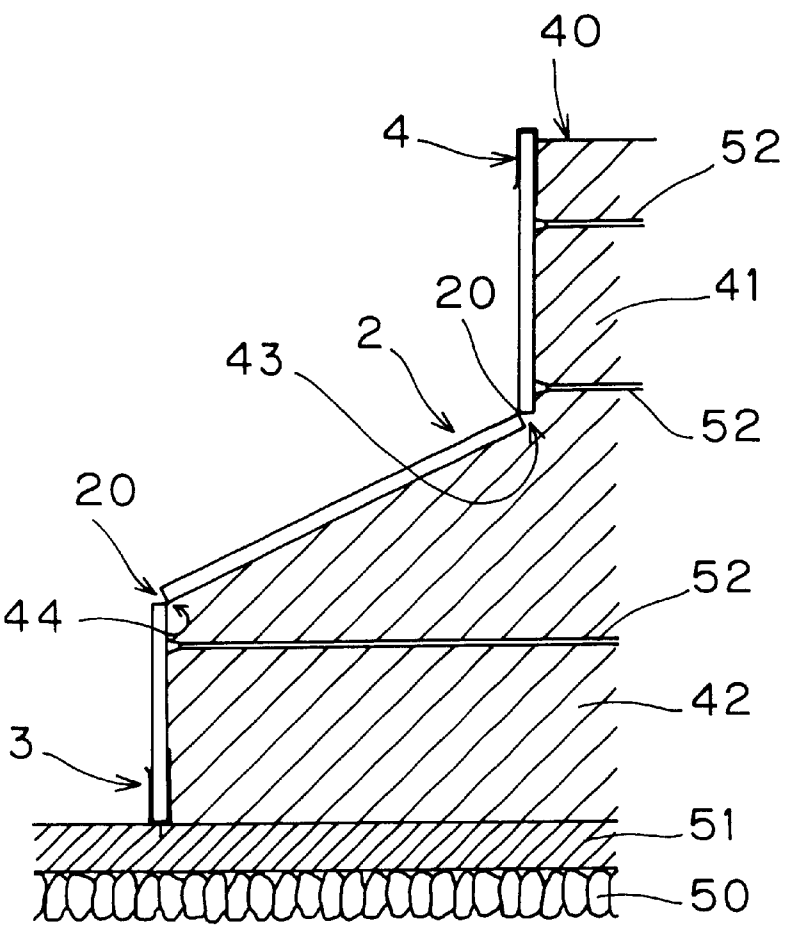

The height position of the guiding portion for bending 20 is adjusted depending on the concrete building to be constructed. More particularly, in case, for instance, a foundation 30 of an arrangement as illustrated in FIG. 11 is to be constructed as the concrete building, the guiding portions for bending 20 are formed at portions somewhat downward of the ground surface G of the form panels 2, and upper half portions of the form panels 2 are bent downward along the guiding portions for bending 20 upon completion of the foundation 30 for performing back filling of the entire form panels 2 into the ground. In case the thickness of the concrete building is to be varied for different portions in height directions, the guiding portions for bending 20 are formed along corner portions that are formed on outer surfaces of the concrete building. For instance, in a case of a foundation 40 as illustrated in FIG. 12 which comprises a footing beam portion 41 and a footing portion 42, the guiding portions for bending 20 are provided to correspond to two corner portions 43, 44 formed at a lower end portion of the footing beam portion 41 and an upper end portion of the footing portion 42.

Figure 8:
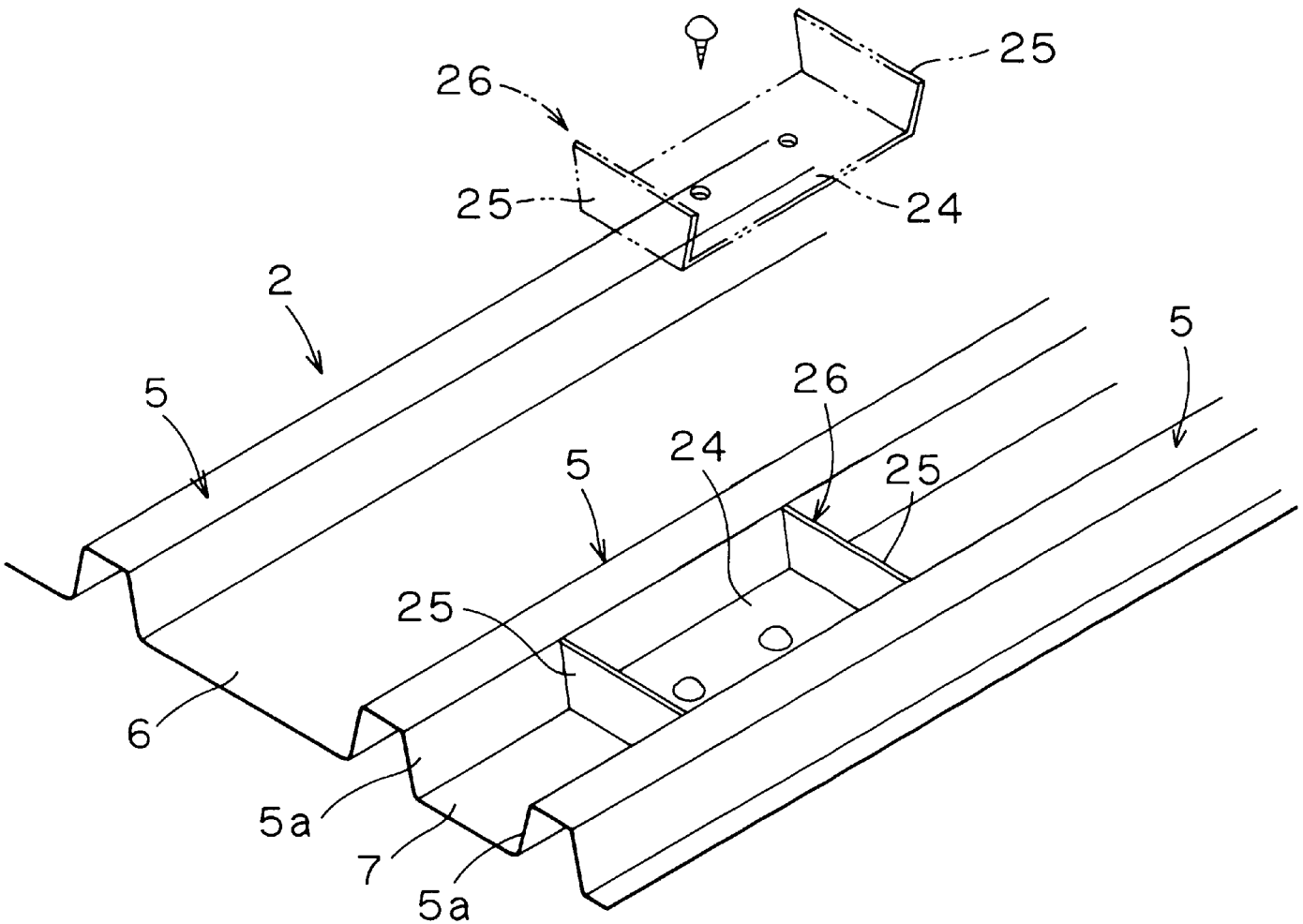
FIG. 8 is an explanatory view of reinforcing members that are attached to the form panel.

If it should be necessary to further reinforce the form panel 2, another member is fixed to the form panel 2 for reinforcement. For instance, in case an intermediate portion in vertical directions of the form panel 2 is deformed in an outwardly expanding direction, a separately arranged reinforcing member 26, which is comprised of a plate-like portion 24 that is overlapped onto the flat portion 7 between adjoining reinforcing projecting lines 5 and uprising portions 25 formed at both upper and lower end portions of the plate-like portion 24 and abutting against the lateral walls 5*a* of the reinforcing projecting lines 5 as illustrated in FIG. 8 is fixed through screwing or the like.

Figure 9:
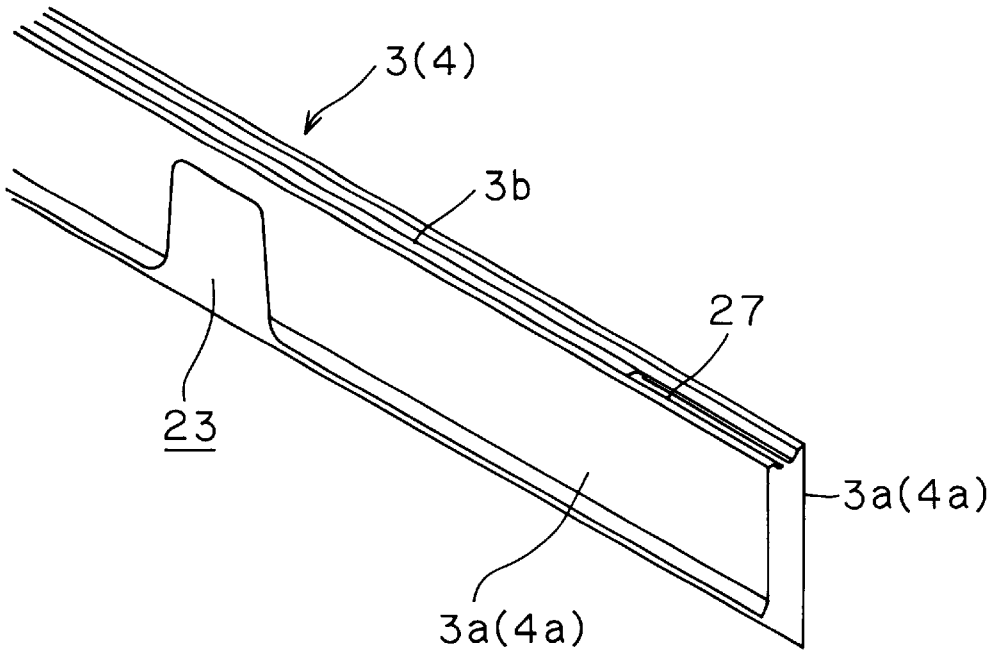
FIG. 9 is a partial perspective view of a reinforcing rail.
Figure 10A:
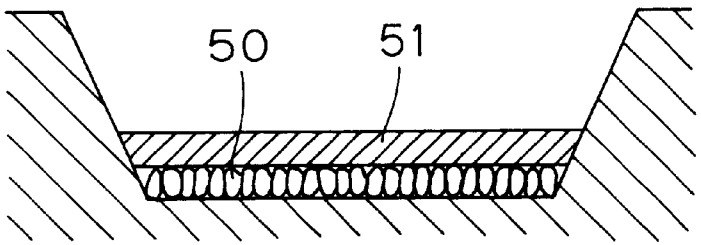
FIG. 10 is an explanatory view of a method for constructing a foundation.
Figure 10B:
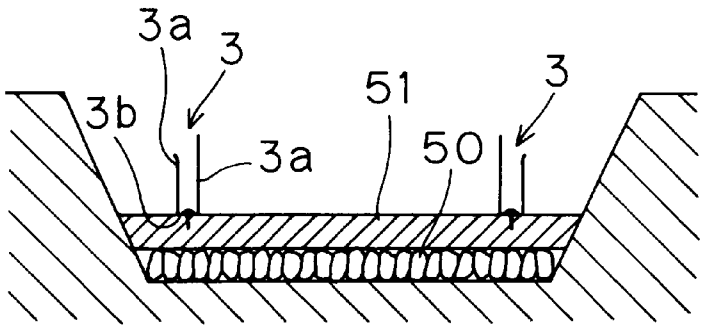
Figure 10C:
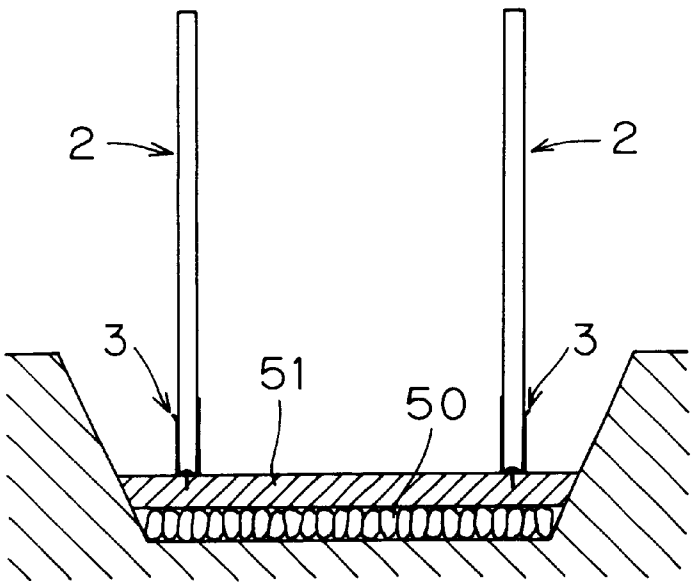
Figure 10D:
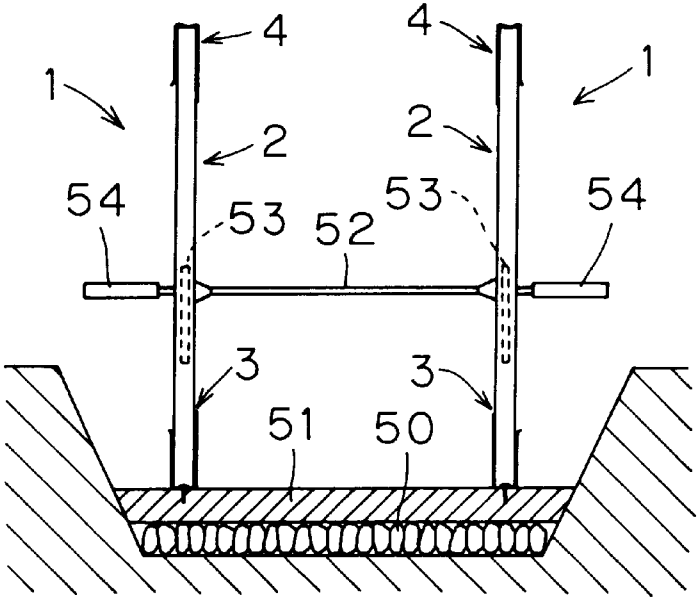

As illustrated in FIGS. 1 and 9, the upper and lower reinforcing rails 3, 4 are formed by press forming a metallic plate, similarly to the form panels 2, to assume a substantially U-shaped section, and are outwardly fitted and fixed to upper and lower portions of each form panel 2 for retaining the shape of the form panel 2 in a plate-like shape. Although it is possible to arrange the upper and lower reinforcing rails 3, 4 of members of different shapes, it is preferably to arrange these of members of identical shapes for reducing the manufacturing costs by decreasing types of parts and to prevent assembly errors of the reinforcing rails 3, 4.

The spaces between opposing lateral walls 3*a*, 4*a* of the reinforcing rails 3, 4 are respectively set to be somewhat broader than the height of the reinforcing projecting lines 5 of the form panel 2 such that the rails may be outwardly fitted to upper and lower edges of the form panel 2. Either one of the lateral walls 3*a*, 4*a* of the reinforcing rails 3, 4 is formed with notched portions 23 at specified intervals in lateral directions such that tip end portions of a nailing machine (not shown) may be inserted into these notched portions 23 of the lower reinforcing rails 3 such that the concrete sub-slab may be fixed thereat. While it is not necessary to form these notched portions 23 for the upper reinforcing rail 4, they are simply formed for the purpose of arranging the upper and lower reinforcing rails 3, 4 of identical members. It is alternatively possible to form a pair of cuttings into the lateral walls 3*a*, 4*a* instead of the notched portions 23 such that the tip end portions of the nailing machine may be inserted by cutting and raising portions formed between the cuttings.

Cutting portions 27 extending in lateral directions are formed on intermediate walls 3*b*, 4*b* between both lateral walls 3*a*, 4*a* at one end portion of the reinforcing rails 3, 4 such that the reinforcing rails 3, 4 may be fitted and fixed to end portions of adjoining reinforcing rails 3, 4 with the space between both lateral walls 3*a*, 4*a* of the reinforcing rails 3, 4 being expanded through these cutting portions 27.

A method for constructing a foundation by using the above-described forms 1 will now be explained.

As illustrated in FIG. 10(*a*), a position for constructing the foundation is first excavated to a set depth and upon laying a rubble 50 to a groove bottom portion thereof, a concrete sub-slab 51 is installed.

Upon construction of a required reinforcement (not shown) onto the concrete sub-slab, lower reinforcing rails 3 are fixed onto the concrete sub-slab 51 to both sides with the reinforcement interposed between as illustrated in FIG. 10(*b*). More particularly, a pair of lower reinforcing rails 3 is disposed onto the concrete sub-slab 51 to be parallel at a set distance with respect to each other with their intermediate walls 3*b* facing downward and their notched portions 23 facing outward, and tip end portions of a nailing machine are inserted into the notched portions 23 for nailing and fixing the lower reinforcing rails 3 to the concrete sub-slab 51.

Next, lower ends of the form panels 2, which are erected in longitudinal directions such that the reinforcing projecting lines 5 are facing outward, are inserted to the lower reinforcing rails 3 and the form panels 2 are sequentially assembled to the pair of reinforcing rails 3. At this time, adjoining form panels 2 are attached to the lower reinforcing rails 3 with lateral edges thereof being overlapped and the engaging projecting portions 12 being engaged to the engaging holes 11 in a tentative manner.

The form panels 2 are then fixed to the lower reinforcing rails 3 through screws and adjoining form panels 2 are also fixed through screws. Further, for setting the space between form panels 2 that are disposed to be parallel to each other to be a set value, a separator 52 is set to bridge between both form panels 2 as illustrated in FIG. 10(*d*) and wall spacers 54 are fastened with back plates 53 being interposed to both end portions of the separator 52 projecting to both sides of the form panels 2 that are disposed to be parallel to each other. At this time, the height positions of the form panels 2 with respect to the lower reinforcing rails 3 are adjusted to a certain degree such that the upper edges of the form panels 2 assume set heights whereupon both members are fixed through screws.

As illustrated in FIG. 10(*d*), the upper reinforcing rails 4 are then outwardly fitted and attached to upper end portions of the form panels 2, and by accurately adjusting height positions of the upper reinforcing rails 4 with respect to the form panels 2 such that the heights of the reinforcing rails 4 are set heights, both members are fixed through screws.

Upon completion of the form 1 in this manner, pipes (omitted in the drawings) are attached to outer sides of the form panels 2 in lateral directions, and if required, pipes are further attached in vertical directions as well, and upon connecting the wall spacers 54 to these pipes, concrete is installed to between the form 1. Since a part of the installed concrete will seep to the outer surface side of the form panels 2 through the outlet holes 15 and the slits 18 and cure, the bonding strength between the installed concrete and the form panels 2 is increased such that the condition in which the form panels 2 closely adhere to the concrete will be maintained though the concrete will shrink upon curing and hardening.

Next, upon curing of the installed concrete, the pipes and wall spacers 54 are removed, and upon bending upper portions of the form 1 downward along the guiding portions for bending 20 as illustrated in FIGS. 11(*a*) and (*b*), back filling is performed such that the entire form 1 is embedded as illustrated in FIG. 11(*c*) whereupon the foundation 30 is completed.

In case of constructing the foundation 40 comprised with the footing beam portion 41 and the footing portion 42 as illustrated in FIG. 12, form panels 12 are employed of which guiding portions for bending 20 are formed to correspond to upper and lower corner portions 43, 44 that are formed at boundary portions of the footing beam portion 41 and the footing portion 42 for constructing the form 1 to the position for constructing the foundation in a similar manner as described above. However, the form panels 2 will be bent to suit along the shape of the lateral surfaces of the foundation 40 with the guiding portion for bending 20 being the center before or after assembly of the form panels 2 to the lower reinforcing rails 3. Upon curing of the installed concrete, the upper portion of the form 1 is bent with the upper guiding portion for bending 20 being the center to thereby perform back filling of the entire form 1.

It is alternatively possible to construct concrete buildings other than the foundation, such as columns, walls or floors of a building by using the above-described form 1 . It is also possible to arrange the form by concurrently using the form 1 and a form that is not comprised with the guiding portions for bending 20.

EFFECTS OF THE INVENTION

Since the form panel may be bent along the guiding portion for bending in case of the ultra thin-type metallic form panels in accordance with the first and second preferred embodiments, the form panel may be bent to assume a shape that corresponds to a shape of an outer surface of a concrete building even though it may include portions which thicknesses differ from each other such that a possible scope of constructing the concrete building that may be built in a single step is achieved by installing concrete once to thereby decrease the number of constructing forms, and it is therefore possible to remarkably save labor in constructing the concrete building.

When constructing the foundation as a concrete building, a portion of the form panel that is exposed above the ground surface may be bent downward along the guiding portion for bending to thereby embed the entire form panel into the ground. In other words, since it is possible to perform construction such that no form panel is exposed to the exterior upon completion of back filling of the foundation, operations for forming finishing mortar to the form panels may be omitted and labor for performing construction may be remarkably saved.

In case where the guiding portions for bending are formed to correspond to corner portions of lateral surfaces of a foundation of a building to be constructed, as in the third preferred embodiment of the present invention, it is possible to construct the foundation in a single step even though the foundation may include a footing portion and a footing beam portion, and it is therefore possible to remarkably save labor when constructing the foundation.

In the case where the guiding portions for bending are formed to be disposed downward of a ground surface when constructing a foundation for a building, as in the fourth preferred embodiment of the present invention, by bending the portion of the form panel that is exposed above the ground surface downward along the guiding portion for bending upon completion of the foundation, the advantage is achieved wherein no finishing mortar needs to be constructed to a portion of the form panel that is exposed above the ground surface. Thus, foundation constructing operations are remarkably saved.

In case clinch portions are formed to be successive in longitudinal directions to both lateral edges of the metallic plate in lateral directions as in accordance with a fifth preferred embodiment of the present invention, it is possible to prevent lateral edges of form panels from becoming sharp thereby preventing inconveniences in which one may cut one's fingers at the time of construction so that safety of handling form panels may be improved.

In the case wherein engaging holes are formed on one side portion of the form panel in the lateral direction while engaging projecting portions are formed on the other side portion in the lateral direction for engaging the engaging projecting portions to the engaging holes so that adjoining form panels are made to be connectable as in the sixth preferred embodiment of the present invention, operations for combining adjoining form panels may be effectively performed.

In the case where outlet holes with aperture widths allowing seepage of concrete are formed on the form panel between adjoining reinforcing projecting lines as in the seventh preferred embodiment in accordance with the present invention, it is possible to prevent clearances from being formed between the concrete and the form panels upon shrinkage of the installed concreted through curing so that the strength of the outer surface of the concrete building may be improved.

According to the form of the eighth preferred embodiment of the present invention, the shape of the form is retained in a plate-like manner through the reinforcing projecting lines formed on the form panels and a first and second reinforcing rail outwardly fitted and fixed to both lateral edges of the form panel in longitudinal directions along the lateral direction of the form panel, and deformation of the form panels upon receiving pressure of installed concrete may be effectively restricted. Further, by bending the form panel along the guiding portion for bending, a possible scope of constructing the concrete building that may be built in a single step is achieved by installing concrete once to thereby decrease the number of constructing forms. Further, since the form panels may be prevented from being exposed to the exterior when constructing the foundation, operations for forming finishing mortar to the form panels may be omitted.

In the case where at least the first reinforcing rail is formed to assume a substantially U-shaped section, and where notched portions for inserting tip end portions of a nailing machine therein are formed at specified intervals on either one of opposing lateral walls of the reinforcing rail as in the ninth preferred embodiment of the present invention, the tip end portions of the nailing machine may be inserted even though the space between the lateral walls of the reinforcing rail is small so that the reinforcing rail may be easily fixed to the concrete sub-slab or the like.

In the case wherein the reinforcing rails are formed to assume a substantially U-shaped section, and wherein the cutting portions extending in lateral directions are formed on one end portion of an intermediate wall that is formed in a successive manner to both lateral walls of the reinforcing rails as in the tenth preferred embodiment of the present invention, it is possible to employ a member having a substantially U-shaped section, which is advantageously strong for use as a reinforcing rail, and because adjoining reinforcing rails may be easily combined.

In the case where both reinforcing rails are arranged to be of identical shapes as in the eleventh preferred embodiment of the present invention, it is possible to reduce costs for manufacturing the reinforcing rails and to reliably prevent assembling errors of the first reinforcing rail and the second reinforcing rail.

In the case where reinforcing members for reinforcing the form panels are fixed to inner sides of the reinforcing projecting lines or between adjoining reinforcing projecting lines as in the twelfth preferred embodiment of the present invention, it is possible to improve the strength of the forms and to prevent deformation of the form panels upon receiving pressure of installed concrete in an even more effective manner.

According to the method for constructing a foundation in accordance with the thirteenth preferred embodiment of the present invention, the above-described form panels are employed so that by bending the form panel along the guiding portion for bending, a possible scope of constructing the concrete building that may be built in a single step is achieved by installing concrete once to thereby decrease the number of constructing forms. Further, since the form panels may be prevented from being exposed to the exterior when constructing the foundation, operations for forming finishing mortar to the form panels may be omitted.

In the case where the form panels are bent at guiding portions for bending so that the form panels fit along lateral surfaces of the foundation at the time of constructing the forms as in the fourteenth preferred embodiment of the present invention, it is possible to build the foundation in a single step by installing concrete when the form panels are bent to correspond to the shapes of the outer surfaces of the foundation even though the foundation may include a footing portion and a footing beam portion.

In the case wherein back filling of the foundation is performed upon installing concrete to between both forms for curing and hardening and after bending the forms that are exposed to above the ground surface in a downward manner along the guiding portions for bending as in the fifteenth embodiment of the present invention, it is possible to prevent the form panels from being exposed from the ground surface and to omit operations for constructing finishing mortar to the form panel.

In the case wherein the form is constructed by adjusting a position for fixing the form panel to the first reinforcing rail and a position for fixing the second reinforcing rail to the form panel such that a height of the second reinforcing rail becomes a set value as in the sixteenth preferred embodiment of the present invention, the heights of the upper ends of the form may be accurately adjusted to meet the set value.

What is claimed is:

1. An ultra thin form panel in which a plurality of reinforcing projecting lines extending in longitudinal directions obtained by bending a metallic plate are formed in an aligned manner with intervals being formed in lateral directions, wherein guiding portions for bending are formed at intermediate portions in the longitudinal directions by cutting at least top surfaces and both lateral sides of the respective reinforcing projecting lines in lateral directions and the remaining portions remain as coupling portions, wherein engaging holes are formed on one side portion of the form panel in the lateral direction and engaging projecting portions are formed on another side portion in the lateral direction such that adjoining form panels are made to be connectable.

2. An ultra thin form panel in which a plurality of reinforcing projecting lines extending in longitudinal directions obtained by bending a metallic plate are formed in an aligned manner with intervals being formed in lateral directions, wherein at least a part of top surfaces of respective reinforcing projecting lines are remained as coupling portions at intermediate portions in longitudinal directions while the remaining portions are cut in lateral directions to form guiding portions for bending, wherein engaging holes are formed on one side portion of the form panel in the lateral direction while engaging projecting portions are formed on the other side portion in the lateral direction such that adjoining form panels are made to be connectable.

3. An ultra thin form panel as claimed in claim 1 or 2, wherein the guiding portions for bending are formed to correspond to corner portions of lateral surfaces of a foundation of a building to be constructed.

4. An ultra thin form panel as claimed in claim 1 or 2, wherein the guiding portions for bending are formed to be disposed downward of a ground surface when constructing a foundation for a building.

5. An ultra thin form panel as claimed in claim 1 or 2, wherein clinch portions are formed to be successive in longitudinal directions to both lateral edges of the metallic plate in lateral directions.

6. An ultra thin form panel as claimed in claim 1 or 2, wherein outlet holes with aperture widths allowing seepage of concrete are formed on the form panel between adjoining reinforcing projecting lines.

7. A form comprising:

an ultra thin form panel in which a plurality of reinforcing projecting lines extending in longitudinal directions obtained by bending a metallic plate are formed in an aligned manner with intervals being formed in lateral directions, wherein guiding portions for bending are formed at intermediate portions in the longitudinal directions by cutting at least top surfaces and both lateral sides of the respecting reinforcing projecting lines in lateral directions and the remaining portions remain as coupling portions, and a first and second reinforcing rail outwardly fitted and fixed to both lateral edges of the form panel in longitudinal directions along the lateral direction of the form panel for retaining the form panel in a plate like shape.

8. A method for constructing a foundation employing the form as claimed in claim 7, comprising the steps of:

fixing a pair of first reinforcing rails to be spaced apart from each other in a substantially parallel manner on specified positions of a concrete sub-slab laid on a construction side and fitting and fixing form panels to both first reinforcing rails, and constructing a pair of forms by respectively fitting and fixing second reinforcing rails on upper end portions of the form panels, and installing concrete to between both forms upon assembling a separator to bridge over both forms for setting a space between these.

9. A form comprising:

an ultra thin form panel in which a plurality of reinforcing projecting lines extending in longitudinal directions obtained by bending a metallic plate are formed in an aligned manner with intervals being formed in lateral directions, wherein at least a part of top surfaces of respective reinforcing projecting lines are remained as coupling portions at intermediate portions in longitudinal directions while the remaining portions are cut in lateral directions to form guiding portions for bending, and a first and second reinforcing rail outwardly fitted and fixed to both lateral edges of the form panel in longitudinal directions along the lateral direction of the form panel for retaining the form panel in a plate like shape.

10. A method for constructing a foundation employing the form as claimed in claim 9, comprising the steps of:

fixing a pair of first reinforcing rails to be spaced apart from each other in a substantially parallel manner on specified positions of a concrete sub-slab laid on a construction side and fitting and fixing form panels to both first reinforcing rails, and constructing a pair of forms by respectively fitting and fixing second reinforcing rails on upper end portions of the form panels, and installing concrete to between both forms upon assembling a separator to bridge over both forms for setting a space between these.

11. The form as claimed in claim 7 or 9, wherein at least the first reinforcing rail is formed to assume a substantially U-shaped section, and wherein notched portions for inserting tip end portions of a nailing machine therein are formed at specified intervals on either one of opposing lateral walls of the reinforcing rail.

12. The form as claimed in claim 7 or 9, wherein the reinforcing rails are formed to assume a substantially U-shaped section, wherein cutting portions extending in lateral directions are formed on one end portion of an intermediate wall that is formed in a successive manner to both lateral walls of the reinforcing rails, and wherein spaces between opposing lateral walls of the reinforcing rails are adjusted via the cutting portions such that adjoining reinforcing rails may be fitted together.

13. The form as claimed in claim 7 or 9, wherein both reinforcing rails are arranged to be of identical shapes.

14. The form as claimed in claim 7 or 9, wherein reinforcing members for reinforcing the form panels are fixed to inner sides of the reinforcing projecting lines or between adjoining reinforcing projecting lines.

15. The method for constructing a foundation as claimed in claim 8 or 10, wherein the form panels are bent at guiding portions for bending such that the form panels fit along lateral surfaces of the foundation at the time of constructing the forms.

16. The method for constructing a foundation as claimed in claim 8 or 10, wherein back filling of the foundation is performed upon installing concrete to between both forms for curing and hardening and after bending the forms that are exposed to above the ground surface in a downward manner along the guiding portions for bending.

17. The method for constructing a foundation as claimed in claim 8 or 10, wherein the form is constructed by adjusting a position for fixing the form panel to the first reinforcing rail and a position for fixing the second reinforcing rail to the form panel such that a height of the second reinforcing rail becomes a set value.

* * * * *